US010984749B2

(12) United States Patent
Kim et al.

(10) Patent No.: US 10,984,749 B2
(45) Date of Patent: Apr. 20, 2021

(54) CURRENT REUSE CIRCUIT

(71) Applicants: INNOAXIS CO., LTD, Namyangju-si (KR); Aconic Inc., Gwangju (KR)

(72) Inventors: Hwi-Cheol Kim, Seoul (KR); Min Jae Lee, Gwangju (KR)

(73) Assignee: ACONIC INC., Gwangju (KR)

( * ) Notice: Subject to any disclaimer, the term of this patent is extended or adjusted under 35 U.S.C. 154(b) by 0 days.

(21) Appl. No.: 16/257,239

(22) Filed: Jan. 25, 2019

(65) Prior Publication Data

US 2019/0279591 A1 Sep. 12, 2019

(30) Foreign Application Priority Data

Mar. 7, 2018 (KR) ..... 10-2018-0026892

(51) Int. Cl.
*G09G 3/36* (2006.01)

(52) U.S. Cl.
CPC ..... *G09G 3/3696* (2013.01); *G09G 3/3685* (2013.01); *G09G 2330/021* (2013.01)

(58) Field of Classification Search
CPC ..... G09G 2330/021; G09G 2330/028; G09G 3/3275; G09G 3/3685; G09G 3/3696
See application file for complete search history.

(56) References Cited

U.S. PATENT DOCUMENTS

2002/0018059 A1* 2/2002 Yanagi ..... H04N 3/127 345/204
2009/0219270 A1* 9/2009 Penev ..... G09G 3/3688 345/211
2015/0325200 A1* 11/2015 Rho ..... G09G 3/20 345/212
2017/0132966 A1* 5/2017 Lim ..... G09G 3/2092
2019/0237012 A1* 8/2019 Ichikura ..... G09G 3/3233

FOREIGN PATENT DOCUMENTS

JP H05-059773 3/1993
JP 2009-516228 A 4/2009
KR 10-1563252 10/2015

* cited by examiner

*Primary Examiner* — Dmitry Bolotin
(74) *Attorney, Agent, or Firm* — Paratus Law Group, PLLC

(57) ABSTRACT

A display apparatus includes a first circuit configured to process a signal between a first top voltage and a first bottom voltage, a second circuit configured to process a signal between a second top voltage and a second bottom voltage, and a second circuit power source configured to receive a current provided by the first circuit and provide the second top voltage to the second circuit.

15 Claims, 11 Drawing Sheets

CURRENT REUSE CIRCUIT

CROSS-REFERENCE TO RELATED APPLICATION

This application claims priority to and the benefit of Korean Patent Application No. 10-2018-0026892 filed on Mar. 7, 2018, the disclosure of which is incorporated herein by reference in its entirety.

BACKGROUND

The present invention relates to a circuit configured to allow a current to be reused.

In a circuit which operates at a high voltage, N-channel metal oxide semiconductor (NMOS) transistors or NMOS transistors and P-channel metal oxide semiconductor (PMOS) transistors are interposed between a top voltage rail and a bottom voltage rail to perform target functions and are electrically connected. A voltage and a current provided from the top voltage rail are applied to the transistors so that the transistors serve the target functions. The current passing through the transistors is provided to the bottom voltage rail.

SUMMARY

In a conventional circuit, a current provided to a bottom voltage rail is not reused but is flushed to a ground or reference potential, and thus power is consumed. As an example, in a circuit configured to operate between a top voltage of 9 V and a bottom voltage of 2 V, a current collected by the bottom voltage of 2 V is not reused and flows to a reference or ground potential, and thus power is consumed. An object of an embodiment is to reuse the current collected from the bottom voltage rail of a high voltage circuit to reduce unnecessary power consumption.

An aspect of the present invention provides a display apparatus including a first circuit configured to process a signal between a first top voltage and a first bottom voltage, a second circuit configured to process a signal between a second top voltage and a second bottom voltage, and a second circuit power source configured to receive a current provided by the first circuit and provide the second top voltage to the second circuit.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Since descriptions related to the present invention are provided as exemplary embodiments for describing structures and functions thereof, it should not be interpreted that the scope of the present invention is limited to the embodiments described in the specification. That is, since the embodiments are susceptible to various modifications and alternative forms, it should be understood that the scope of the invention covers equivalents falling within the spirit of the present invention.

Meanwhile, terms described in the specification should be understood as follows.

The terms first, second, and the like are used herein to distinguish one element from another element, and the scope of the present invention is not limited thereto. For example, a first element could be termed a second element and a second element could be similarly termed a first element.

The singular forms "a," "an," and "the" are intended to include the plural forms as well, unless the context clearly indicates otherwise. It will be further understood that the terms "comprises," "comprising," "includes," and/or "including," when used herein, specify the presence of stated features, integers, steps, operations, elements, components, and/or groups thereof but do not preclude the presence or addition of one or more other features, integers, steps, operations, elements, components, and/or groups thereof.

The term "and/or" used to describe the embodiments of the present invention is used to indicate each and all thereof. For example, it should be understood that the expression "A and/or B" indicates all of "A, B, and A and B".

While the embodiments of the present invention are described, in a case in which it is determined that a plurality of elements configured to perform similar functions need to be distinguished, symbols such as a, b, c, 1, 2, 3, and the like are added thereto to describe the elements, but in a case in which a plurality of elements do not need to be distinguished, symbols may not be added to describe the elements.

While the embodiments are described, a single line, a differential line, and a bus are not distinguished. However, in a case in which a single ended signal line, a differential signal line, and a bus need to be distinguished, they are distinguished and described.

Unless otherwise defined, all terms used herein are to be interpreted as is customary in the art to which this invention belongs. It should be further understood that terms in common usage should also be interpreted as is customary in the relevant art and not in an idealized or overly formal sense unless expressly so defined herein.

Figure 1:
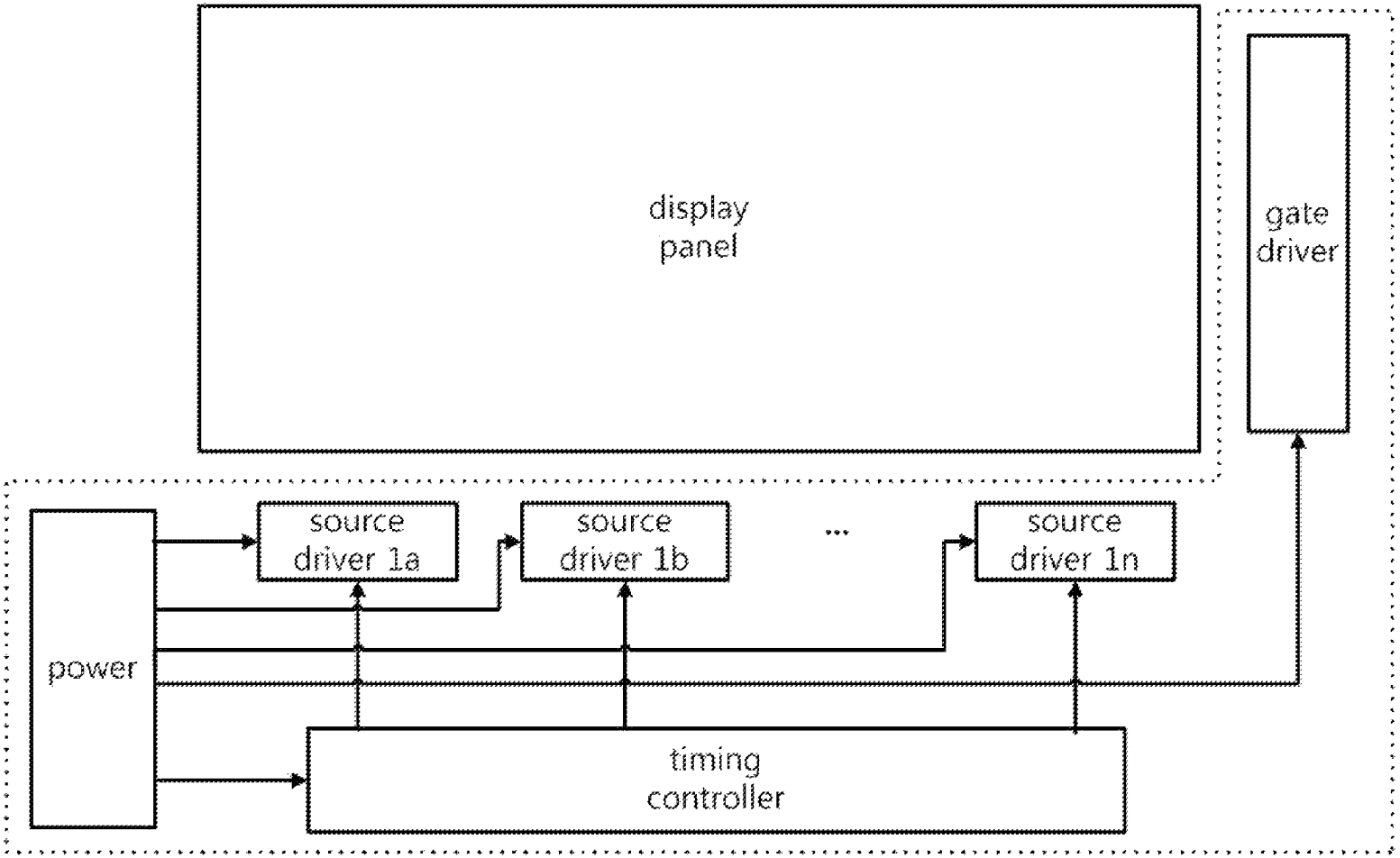
FIG. 1 is a schematic view illustrating a display system.

Hereinafter, examples of a current reuse circuit according to a present embodiment will be described with reference to the accompanying drawings. FIG. 1 is a schematic view illustrating a display system. Referring to FIG. 1, the display system includes a display panel, a gate driver, source drivers 1*a* to 1*n*, and a timing controller configured to change characteristics of a screen source which is externally provided or adjust a driving timing according to a resolution and characteristics of the display system. The timing controller and the source drivers 1*a* to 1*n* may be separately formed according to the characteristics of the display panel, or, as illustrated in the accompanying drawing, the timing controller and the source driver 1*a* to 1*n* may be formed as one chip.

Figure 2:
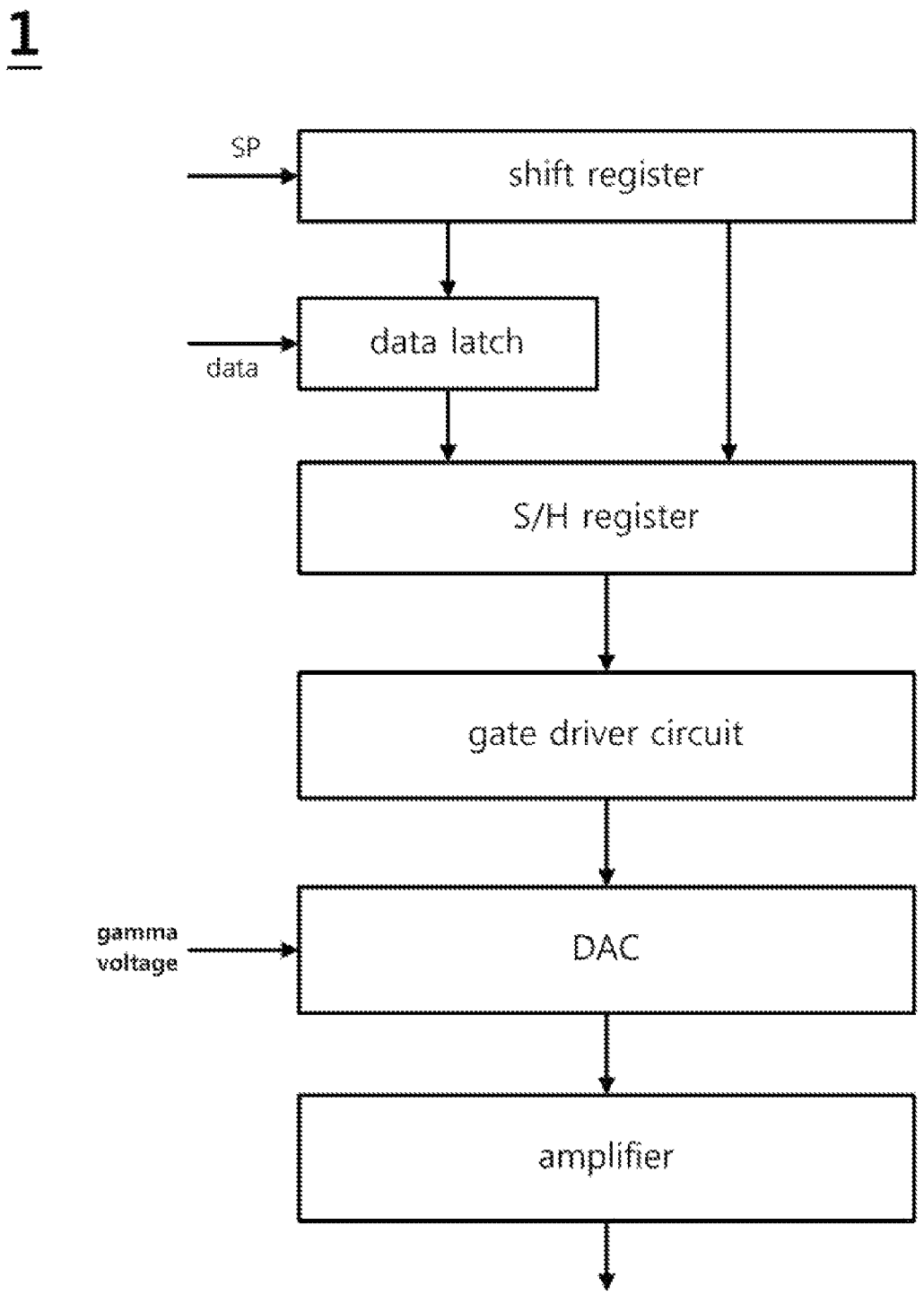
FIG. 2 is a schematic block diagram illustrating a source driver according to a present embodiment.

FIG. 2 is a schematic block diagram illustrating a source driver 1 according to the present embodiment. Referring to FIG. 2, the source driver 1 includes a shift register, a data latch, a sample/hold (S/H) register, a level shifter, a digital-to-analog converter (DAC), and an amplifier. As an example, the amplifier may be a buffer having a unit gain.

The shift register sequentially shifts and outputs start pulses (SP). The data latch latches up and provides image data, and the S/H register samples an image signal, which is lathed up, according to the SP and holds the sampled data to provide the sampled date to the level shifter.

The level shifter receives digital bits to provide an output signal of which a level is shifted to swing between an upper limit voltage and a lower limit voltage. As an example, the DAC receives a gamma voltage, converts the output signal provided by the level shifter to an analog signal, and provides the analog signal to the amplifier, and the amplifier amplifies the analog signal and provides the analog signal to the display panel such that an image corresponding to the input data is displayed. As another example, the DAC receives a voltage as an upper limit voltage in which an upper headroom voltage is added on an upper limit value of a gamma voltage and a voltage as a lower limit voltage in which the gamma voltage is decreased by a lower headroom voltage.

Figure 3:
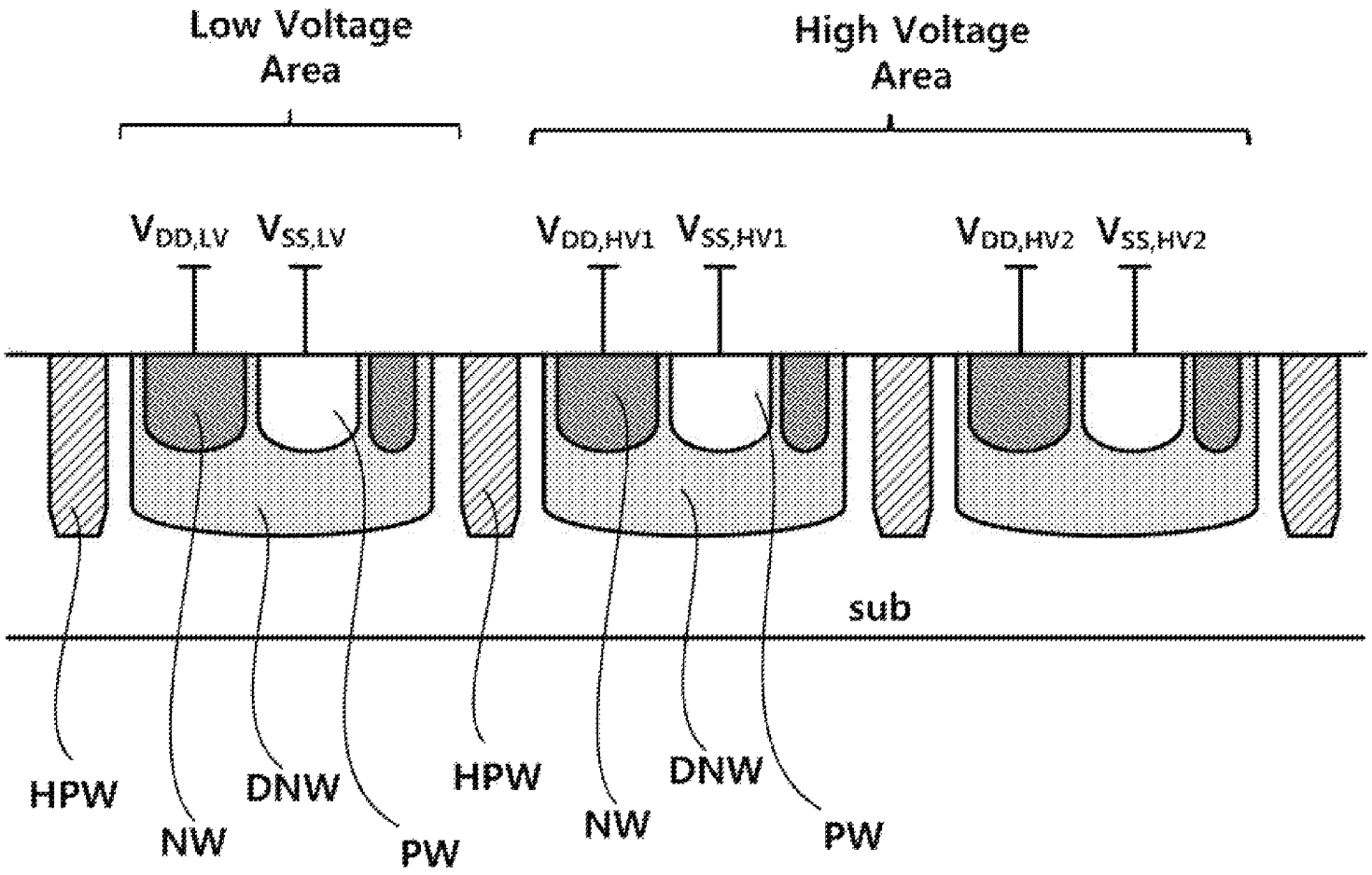
FIG. 3 is a schematic cross-sectional view illustrating a silicon substrate on which the source driver is formed according to the present embodiment.

FIG. 3 is a schematic cross-sectional view illustrating a silicon substrate on which the source driver is formed according to the present embodiment. The source drive 1 may be formed on a semiconductor substrate sub. According to the example illustrated in FIG. 3, the semiconductor substrate sub may be doped with a P-type dopant. The semiconductor substrate sub may be divided into a plurality of areas such as a low voltage area, a high voltage area, and the like according to a voltage range within which a circuit located at a corresponding area operates and/or a voltage range of input and output signals. As an example, a low voltage (LV) circuit 500 such as a digital circuit which operates with a relatively low voltage is located in the low voltage area. In the high voltage area, the level shifter (see FIG. 2) is configured to receive image data which is a digital signal provided by the digital circuit disposed in the low voltage area and to shift a level of the signal to a voltage sufficient to drive the DAC, the DAC (see FIG. 2) driven by the level shifter to generate a gradation voltage corresponding to the image data, the amplifier, and the like.

The low voltage area and the high voltage area may be formed in triple well structures. The triple well structures includes a deep N well (DNW) formed in a P-type substrate, an N well (NW) in which a P-channel metal oxide semiconductor (PMOS) transistor is disposed in the DNW, and a P well (PW) in which an N-channel metal oxide semiconductor (NMOS) transistor is disposed. As an example of the triple well which is not illustrated, the PW is formed in the DNW, and the NW in which the PMOS transistor is disposed is formed in the PW.

Low driving voltages $V_{DD,LV}$ and $V_{SS,LV}$ which are lower than driving voltages provided to the high voltage area are provided to the low voltage area. According to the embodiment illustrated in FIG. 3, a circuit which is driven with the low driving voltages $V_{DD,LV}$ and $V_{SS,LV}$ is disposed in the low voltage area. The circuit operating with the pair of low driving voltages $V_{DD,LV}$ and $V_{SS,LV}$ is disposed within the NW and the PW, and the NW and the PW are biased to the low driving voltages $V_{DD,LV}$ and $V_{SS,LV}$. As an example, the low driving voltages $V_{DD,LV}$ and $V_{SS,LV}$ are 1.2 V and 0 V, respectively. As another example, the low driving voltages $V_{DD,LV}$ and $V_{SS,LV}$ are 1.8 V and 0 V, respectively. As an example which is not illustrated, a plurality of areas in which circuits operate with a plurality of low driving voltages may be disposed in the low voltage area.

The high voltage area has the triple well structure, and PMOS device and NMOS device are respectively disposed in the NW and the PW included in the triple well structure. FIG. 3 shows an example of the high voltage area including an area in which the NW and the PW to which a first top voltage $V_{DD,HV1}$ and a first bottom voltage $V_{SS,HV1}$ are provided are located and an area in which the NW and the PW to which a second top voltage $V_{DD,HV2}$ and a second bottom voltage $V_{SS,HV2}$ are provided are located. As another example which is not illustrated, a single top voltage and a single bottom voltage may be provided to the high voltage area. As another example which is not illustrated, in the high voltage area, a plurality of PWs may be disposed in one DNW, the plurality of PWs may be biased to different voltages, and NMOS elements may be located in the plurality of PWs. In addition, in the high voltage area, a plurality of NWs may be located in one DNW, the plurality of NWs may be biased to different voltages, and PMOS elements may be located in the plurality of NWs.

Figure 4:
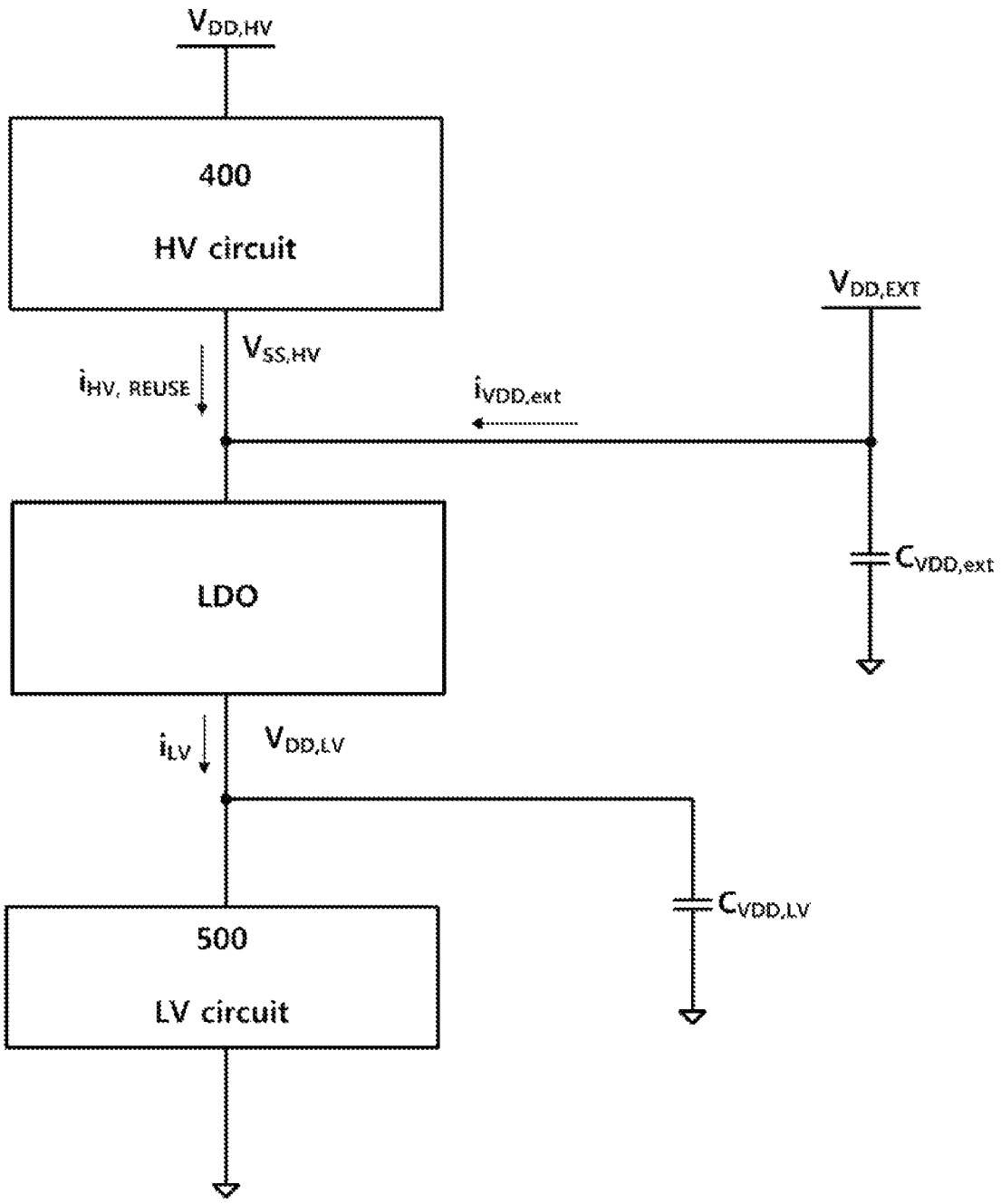
FIGS. 4 to 6 are schematic views illustrating connection relationships between a high voltage (HV) circuit, a low voltage circuit, and a low voltage source according to the present embodiment.
Figure 5:
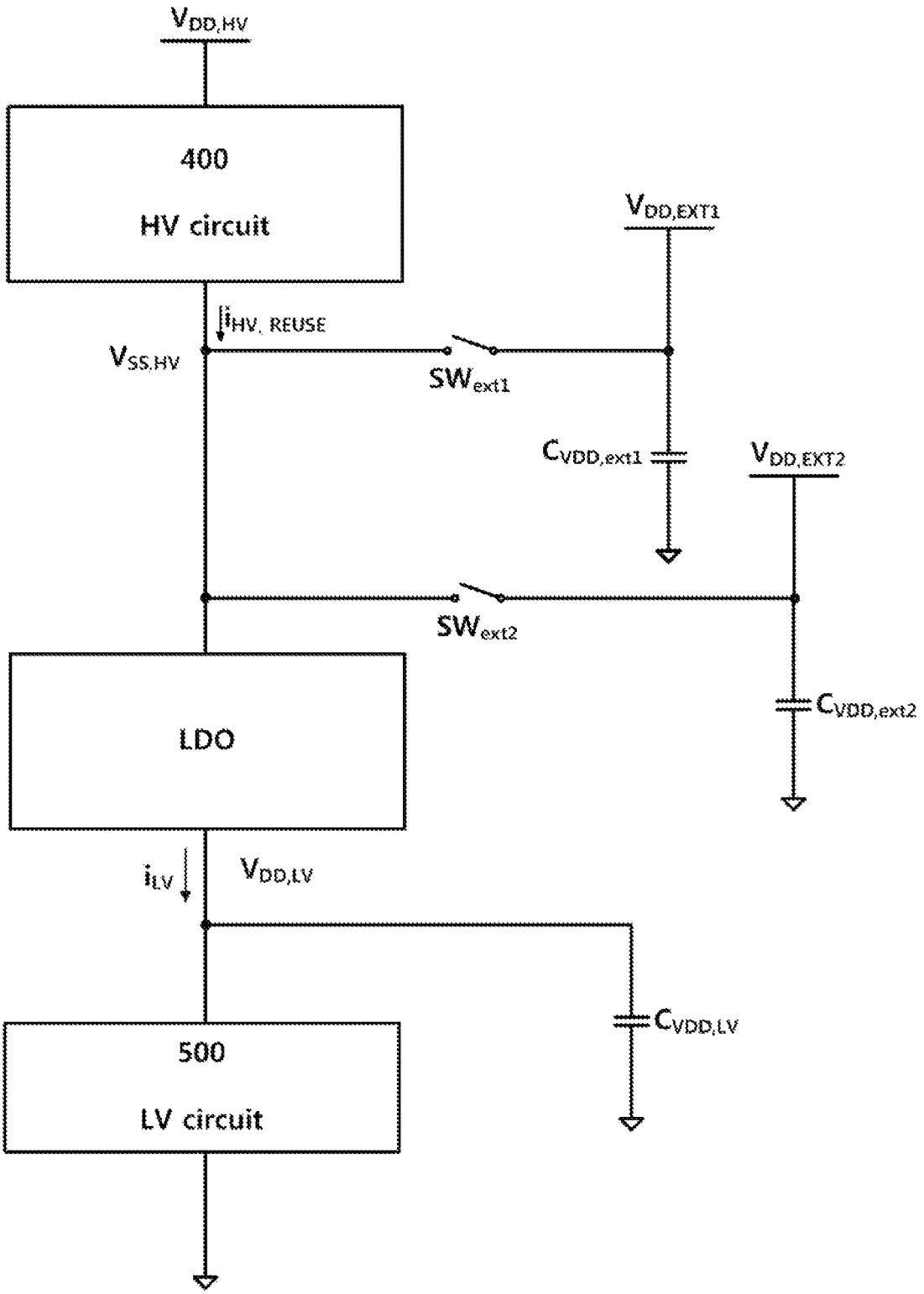
Figure 6:
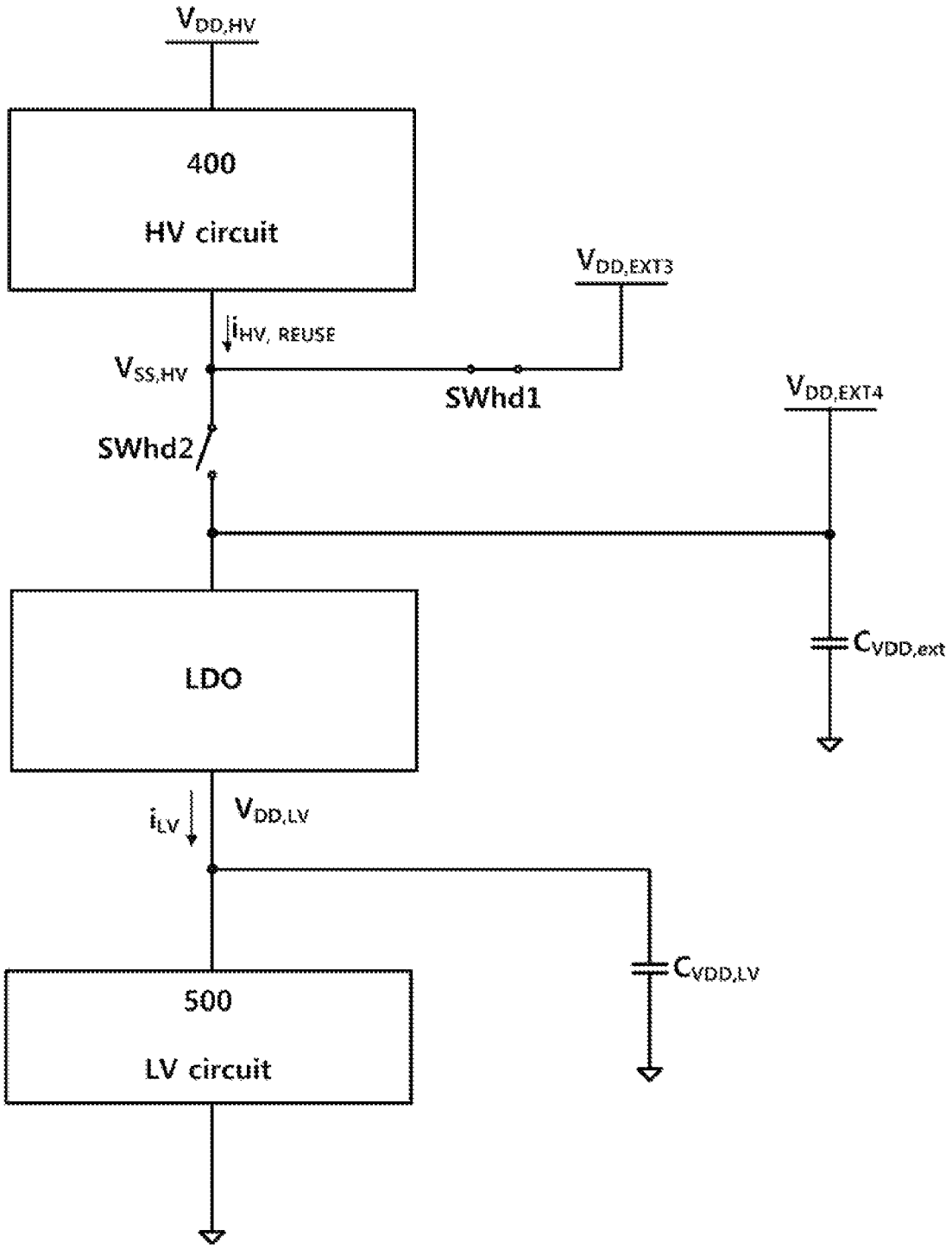
Figure 7A:
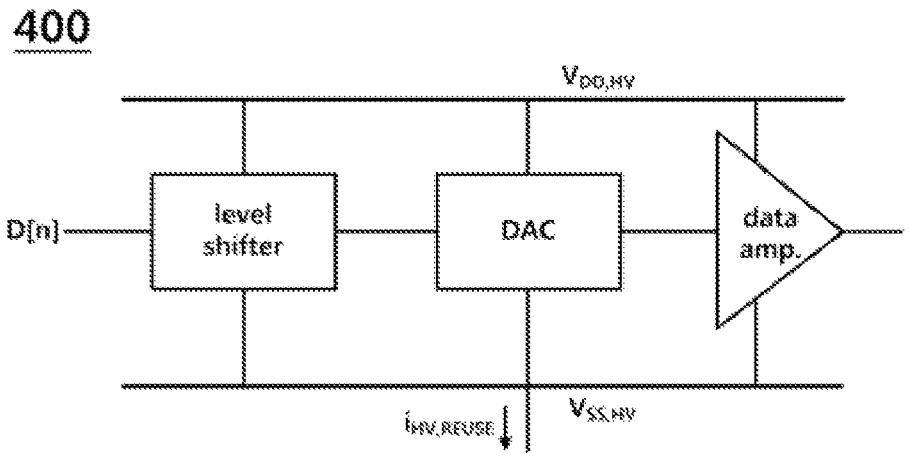
FIGS. 7A to 9B are schematic circuit diagrams illustrating embodiments of an HV circuit (400)
Figure 7B:
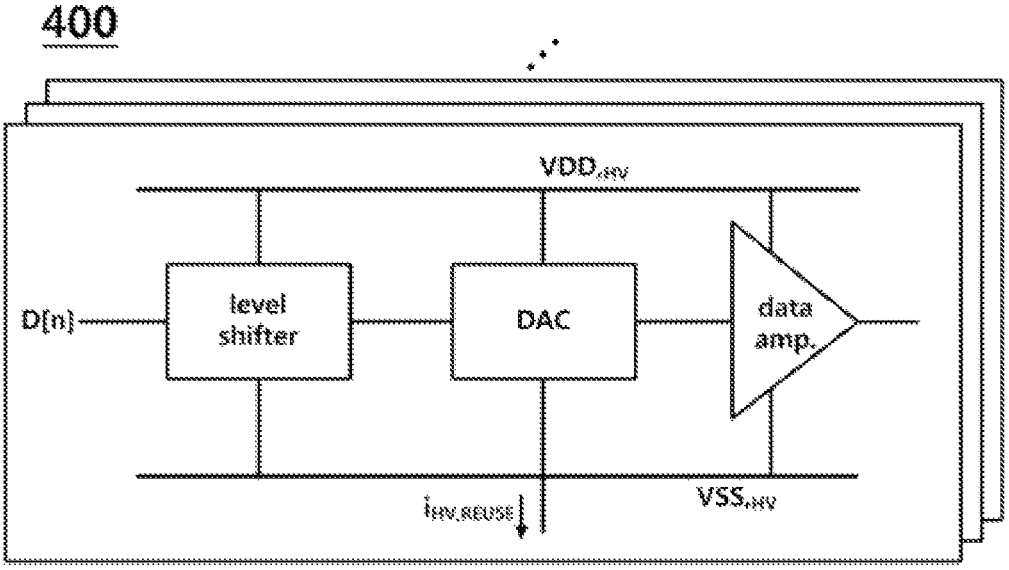

FIGS. 4 to 6 are schematic views illustrating connection relationships between a high voltage (HV) circuit 400, the LV circuit 500, and a low voltage source LDO. Referring to FIGS. 4 and 6, the HV circuit 400 receives a current which is needed to be driven from a rail of a top voltage $V_{DD,HV}$ to operate and sends a current to a rail of a bottom voltage $V_{SS,HV}$.

As one embodiment, the top voltage $V_{DD,HV}$ provided through the rail of the top voltage $V_{DD,HV}$ may be greater than a top voltage $V_{DD,LV}$ of the LV circuit 500, and the bottom voltage $V_{SS,HV}$ provided through a rail of the bottom voltage $V_{SS,HV}$ may be greater than the top voltage $V_{DD,LV}$ of the LV circuit 500. In addition, the bottom voltage $V_{SS,HV}$ is a voltage that is not 0 V and may have a voltage value which is greater than a reference voltage or ground voltage.

As one embodiment, the LV circuit 500 and the HV circuit 400 may be electrically separated from each other by different DNWs in the semiconductor substrate sub (see FIG. 3). Accordingly, the bottom voltage $V_{SS,HV}$ of the HV circuit may have a voltage value which is greater than 0 V unlike the bottom voltage of the LV circuit.

As one embodiment, a range of a voltage processed in the HV circuit 400 is generally higher than a level of a voltage provided to the LV circuit 500. Accordingly, in the circuit divided by the DNWs, the PW may be biased to a voltage which is higher than the ground voltage, and the bottom voltage $V_{SS,HV}$ may be higher than 0 V.

Since the HV circuit 400 stably operates when the bottom voltage $V_{SS,HV}$ is a low impedance, the bottom voltage $V_{SS,HV}$ may be connected to a power rail which is externally provided.

In the embodiment illustrated in FIG. 4, the power rail connected to the bottom voltage $V_{SS,HV}$ of the HV circuit 400 may be connected to any one power source configured to provide a voltage corresponding to a dynamic range of the HV circuit among power sources configured to provide different voltages. As an example, when the bottom voltage $V_{SS,HV}$ of 3 V has to be provided due to a narrow dynamic range of the HV circuit 400, the power rail configured to provide the bottom voltage $V_{SS,HV}$ may be connected to a power source $V_{DD,ext}$ configured to provide 3 V.

As another embodiment, when the bottom voltage $V_{SS,HV}$ has to be 2 V or less due to a wide dynamic range of the HV circuit 400, the power rail configured to provide the bottom voltage $V_{SS,HV}$ may be connected to a power source configured to provide 1.8 V.

In an embodiment illustrated in FIG. 5, a power rail connected to the bottom voltage $V_{SS,HV}$ of the HV circuit 400 may be connected to any one power source configured to provide a voltage corresponding to the dynamic range of the HV circuit among power sources configured to provide different voltages through a bottom power selection switch. As an example, when the bottom voltage $V_{SS,HV}$ of 3 V may be provided due to the narrow dynamic range of the HV circuit 400, the bottom power selection switch $SW_{ext1}$ is turned on so that the power rail configured to provide the bottom voltage $V_{SS,HV}$ may be connected to a power source $V_{DD,ext1}$ configured to provide 3 V.

As another embodiment, when a voltage of 2 V or less is needed to be provided as the bottom voltage $V_{SS,HV}$ due to the wide dynamic range of the HV circuit 400, the bottom power selection switch $SW_{ext2}$ is turned on so that the power rail configured to provide the bottom voltage $V_{SS,HV}$ may be connected to a power source $V_{DD,EXT}$ configured to provide 1.8 V.

In the embodiment illustrated in FIG. 5, two power sources are connected to the bottom voltage rail through the bottom power selection switches, but two or more power sources may provide voltages to the bottom voltage rail through bottom power selection switches to correspond to the dynamic range of the HV circuit 400.

In an embodiment illustrated in FIG. 6, when a wide dynamic range of the HV circuit 400 is required, a first dynamic range securing switch SWhd1 may be turned on and a second dynamic range securing switch SWhd2 may be turned off. As the first dynamic range securing switch SWhd1 is turned on, a voltage $V_{DD,EXT3}$ having a voltage value lower than that of the top voltage of the LV circuit 500 may be provided as the bottom voltage $V_{SS,HV}$ of the HV circuit 400. As the second dynamic range securing switch SWhd2 is turned off, the bottom voltage $V_{DD,EXT3}$ of the HV circuit 400 may be prevented from being provided to the low voltage source LDO.

In an embodiment which is not illustrated, when it is enough that a voltage $V_{DD,EXT4}$ having a voltage value which is higher than that of the voltage $V_{DD,EXT3}$ is provided as the bottom voltage of the HV circuit 400 in the dynamic range of the HV circuit 400, the first dynamic range securing switch SWhd1 may be turned on and the second dynamic range securing switch SWhd2 may be turned on.

According to an embodiment illustrated in FIG. 6, there is an advantage in that the bottom voltage provided to the HV circuit 400 may be adjusted to secure the wide dynamic range of the HV circuit 400. As an example, the voltage $V_{DD3,EXT}$ may be the ground voltage and in this case, the HV circuit 400 may operate like a conventional circuit configuration.

As one embodiment, it may be determined that the top voltage $V_{DD,LV}$ provided to the LV circuit 500 by the low voltage source LDO is 0.9 V, 1 V, 1.2 V, 1.8 V, and the like according to kinds of elements used in the LV circuit 500. The top voltage $V_{DD,LV}$ provided to the low voltage source LDO may be the same as the bottom voltage $V_{SS,HV}$ of the HV circuit 400.

As one embodiment, a voltage value of the bottom voltage $V_{SS,HV}$ of the HV circuit may be higher than that of the top voltage $V_{DD,LV}$ provided to the LV circuit. In addition, the top voltage $V_{DD,LV}$ provided to the low voltage source LDO may be determined according to the bottom voltage $V_{SS,LV}$ of the HV circuit 400.

According to the embodiments illustrated in FIGS. 4 and 5, a current $i_{HV,REUSE}$ provided by the HV circuit 400 is provided to the low voltage source LDO and is thus provided to the LV circuit 500. The low voltage source LDO may be a low dropout regulator (LDO), and the low voltage source LDO provides power needed to operate the LV circuit 500.

When a current $i_{LV}$ is provided to the LV circuit 500 from the low voltage source LDO and the HV circuit 400 does not provide the current $i_{HV,REUSE}$ to the low voltage source LDO, a power source has to provide a current $i_{VDD,ext}$ to the low voltage source. However, when the HV circuit 400 provides the current $i_{HV,REUSE}$ to the low voltage source LDO, a current provided by the power source may be decreased by the current $i_{HV,REUSE}$, and thus power consumption can be decreased.

FIGS. 7A to 9B are schematic circuit diagrams illustrating embodiments of the HV circuit 400. In an embodiment illustrated in FIG. 7A, the HV circuit 400 may include one or more of a level shifter configured to shift a signal D[n] provided as an input of any one channel of the display apparatus to swing the signal D[n] between the top voltage $V_{DD,HV}$ and the bottom voltage $V_{SS,HV}$, a DAC configured to output a signal having a level between the top voltage $V_{DD,HV}$ and the bottom voltage $V_{SS,HS}$ corresponding to the input digital signal D[n], and a data driving amplifier (data amp.) configured to buffer the signal output by the DAC and output the buffered signal. In an embodiment illustrated in FIG. 7B, the HV circuit 400 may include any one or more among level shifters, DACs, and data amplifier corresponding to a plurality of channels.

Figure 8A:
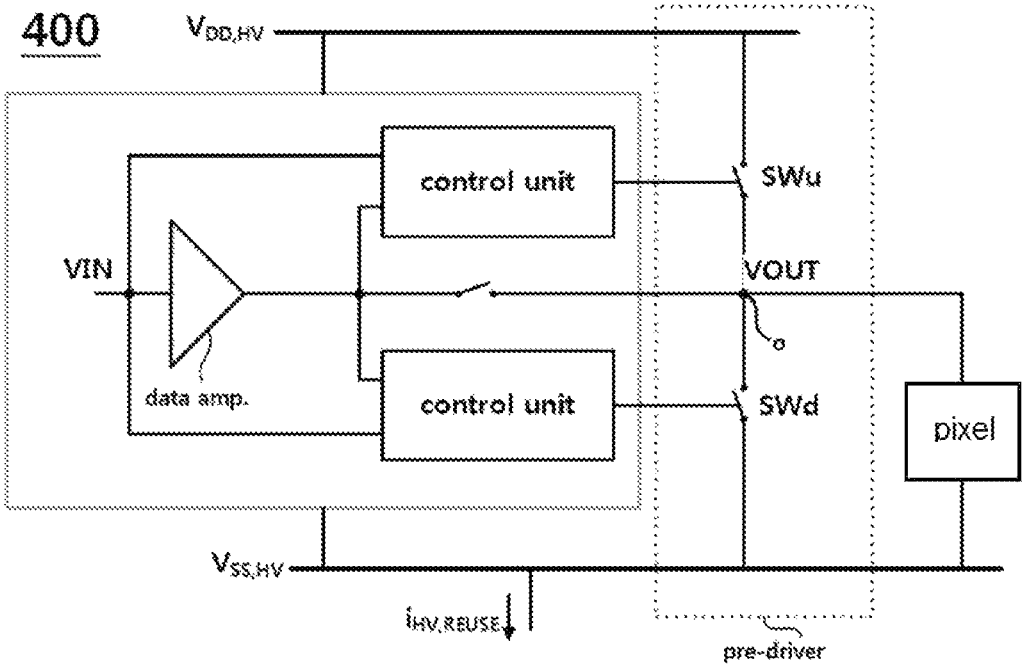

Referring to FIG. 8A, the HV circuit 400 may include circuits having a DAC (not shown) configured to convert image data to an analog signal, a data amplifier, a pre-driver configured to pre-drive a display pixel (shown in FIG. 8A) and/or a line connected to the display pixel with a voltage between the top voltage $V_{DD,HV}$ and the bottom voltage $V_{SS,HV}$ before a target voltage is provided to the display pixel, and the like which are formed in the high voltage area (see FIG. 3).

Control units may include a comparator (not shown) configured to receive and compare a target voltage VIN and a load voltage VOUT to output the result, and a logic gate (not shown) configured to receive an active signal and an output signal of the comparator and perform a logical operation thereon.

Figure 8B:
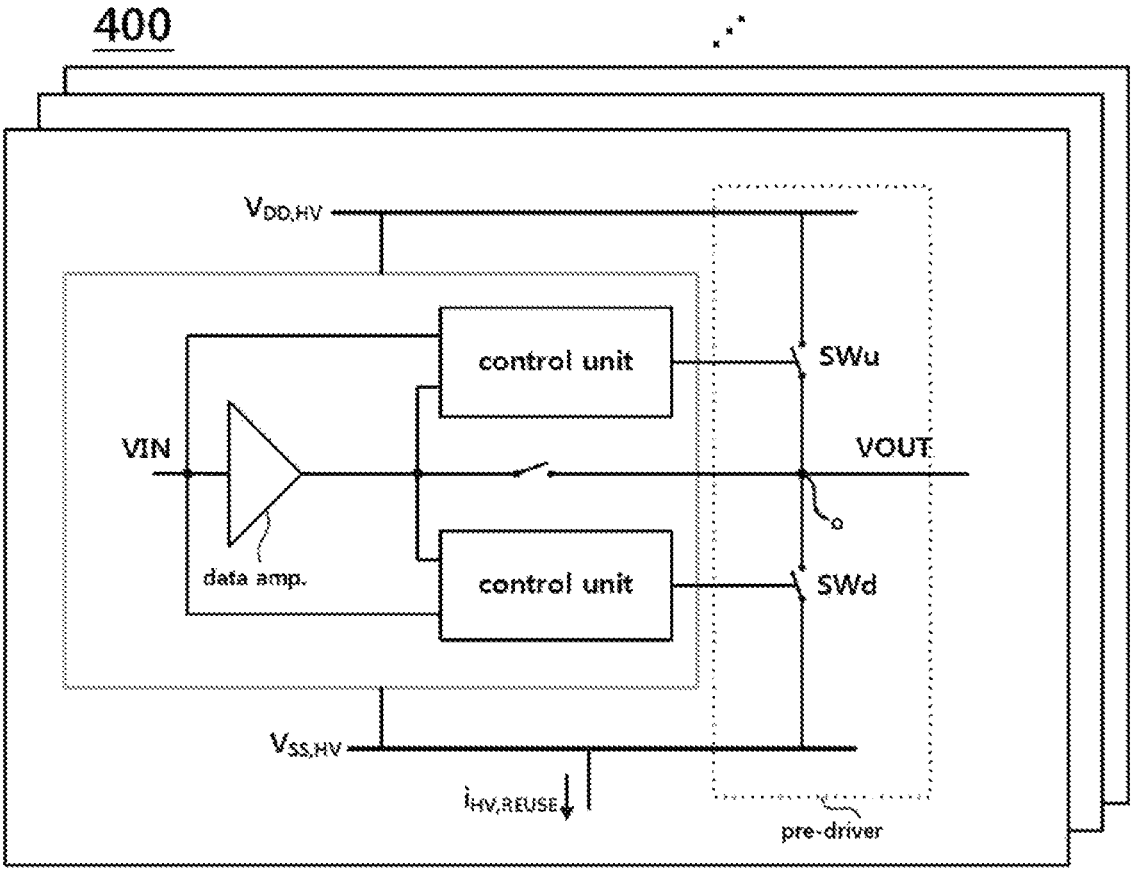

Referring to FIG. 8B, HV circuits 400 may include a plurality of circuits which are each configured to drive a single channel. According to the embodiments illustrated in FIGS. 8A and 8B, since a current provided to a current reuse circuit 10 through the rail of the bottom voltage $V_{SS,HV}$ increases, there is an advantage in that power consumption decreases.

Figure 9A:
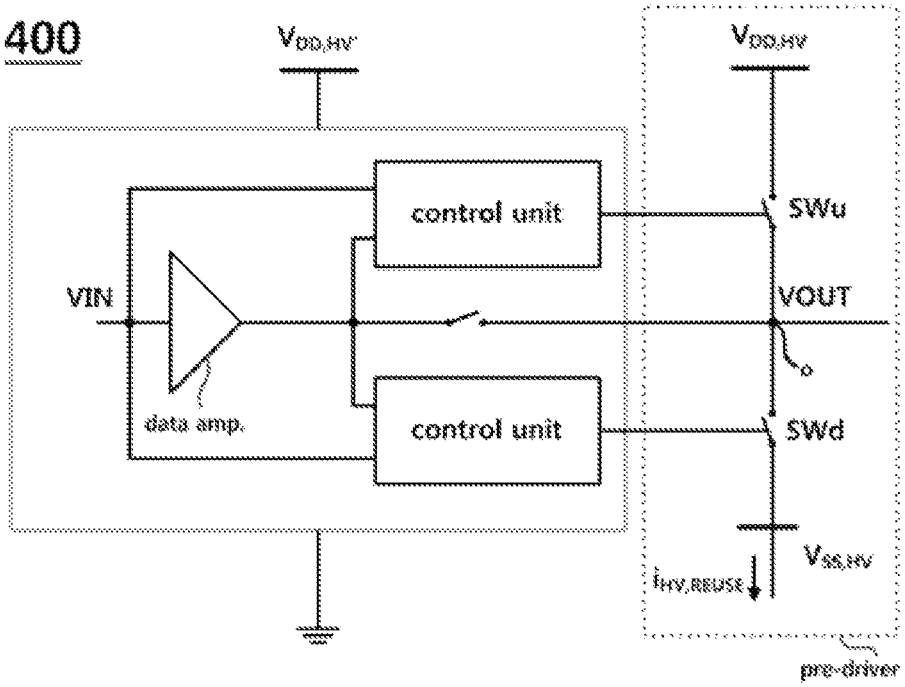
Figure 9B:
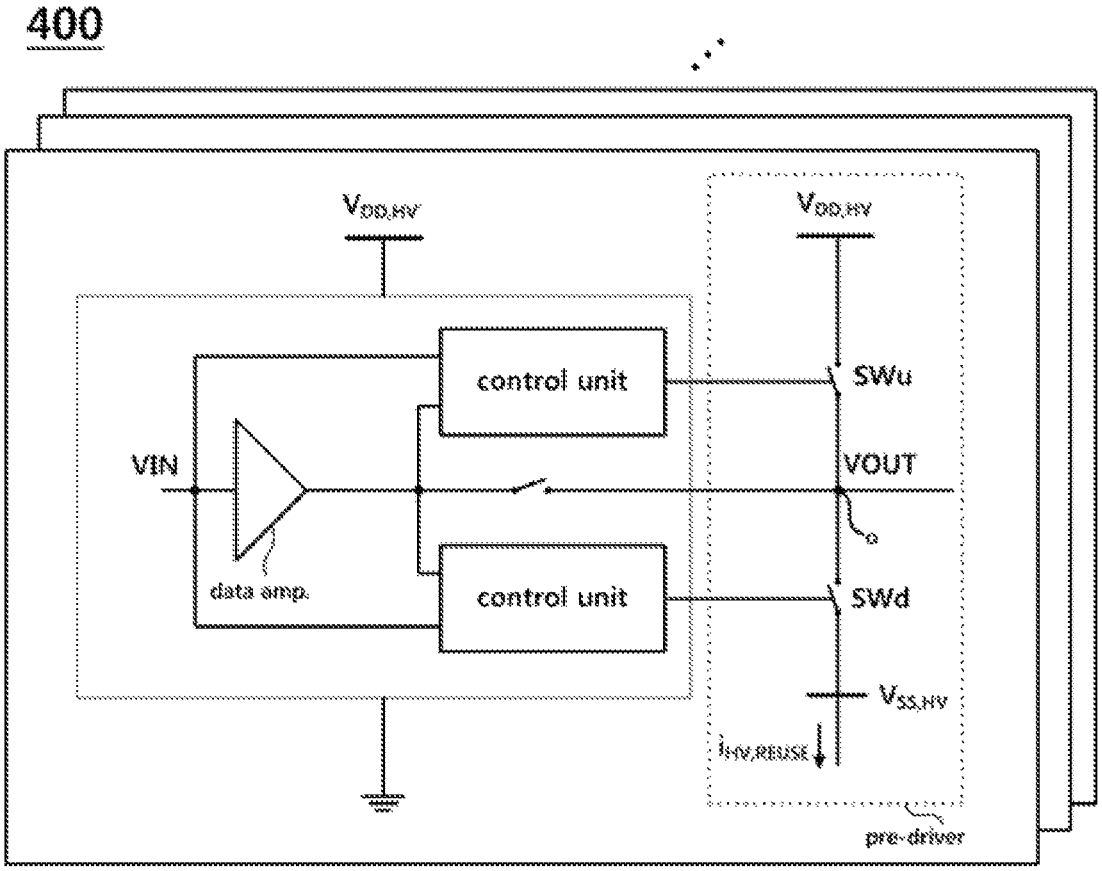

Referring to FIGS. 9A and 9B, the HV circuit 400 connected to the low voltage source LDO may have one or more pre-drivers. The pre-driver and other circuits may receive different top voltages and bottom voltages.

In the case of a display driving circuit, since a plurality of data amplifiers. simultaneously charge or discharge a capacitive load, a peak value of a consumed current is high. Accordingly, a di/dt noise is generated according to a voltage drop (IR drop) of a power terminal and/or a change in a current according to time, and a source voltage provided to the circuits may change.

As an embodiment, noise influences on the main circuits used to drive data may decrease when the top voltage $V_{DD,HV}$ and the bottom voltage $V_{SS,HV}$ are provided to the pre-driver and the top voltage $V_{DD,HV}$ and a ground voltage as the bottom voltage is provided to other circuits other than the pre-driver. In addition, when top voltages $V_{DD,HV}$ and $V_{DD,HV'}$ are divided in a chip and connected to each other through a ferrite bead or a resistor at the outside of the chip, the top voltages $V_{DD,HV}$ and $V_{DD,HV'}$ may be connected from a viewpoint of a direct current (DC), but may be separated from a viewpoint of an alternating current (AC) to decrease the noise influence. In addition, since the current may be reused using the pre-driver, there is an advantage in that current consumption may decrease.

According to another embodiment which is not illustrated, the HV circuit 400 may be a display pixel and a data driving line connected to a source drive and act as a capacitive load. As an embodiment, the source drive may provide a high voltage to the data driving line and the display pixel connected to the data driving line to charge the voltage in the data driving line and the display pixel in order to drive the pixel, and, when a low voltage is provided, charges charged in the capacitive load may be flushed in the form of current through the rail of the bottom voltage $V_{SS,HV}$ connected to the data amplifier and may be provide to the current reuse circuit 10.

The LV circuit 500 is a circuit configured to receive the top voltage $V_{DD,LV}$ to operate. As an embodiment, the top voltage $V_{DD,LV}$ may be a voltage which is lower than or equal to the bottom voltage $V_{SS,HV}$. As an embodiment, the LV circuit 500 may be a digital logic circuit of which power consumption is low. When the present embodiment is applied to a display circuit, the LV circuit may be a digital logic circuit such as a timing controller.

Figure 10:
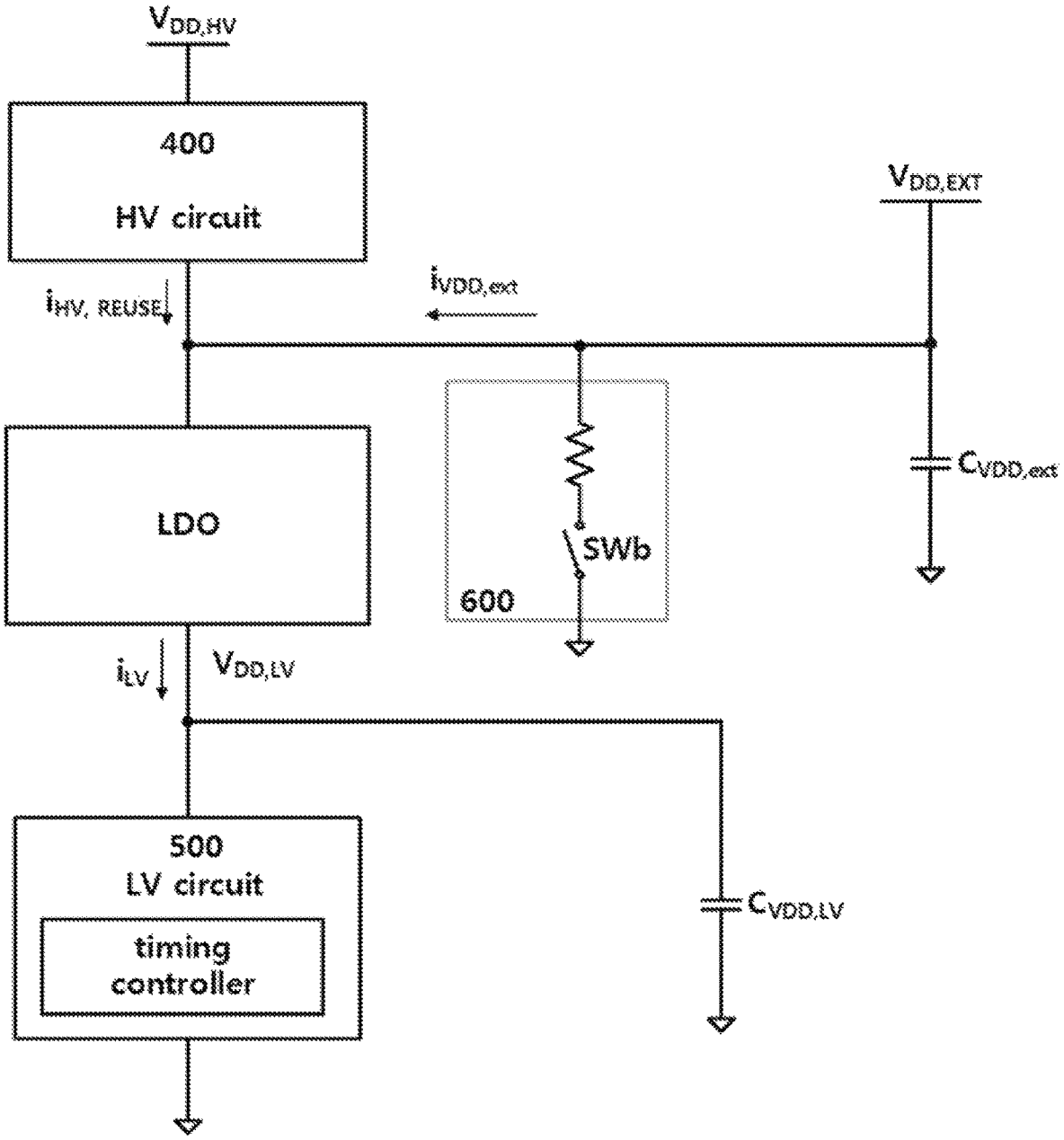
FIG. 10 is a schematic circuit diagram illustrating an embodiment of a current bypass circuit.

FIG. 10 is a schematic circuit diagram illustrating an embodiment of a current bypass circuit. A current bypass circuit 600 may include a bypass switch SWb and a resistor connected to the bypass switch SWb. In an embodiment, the switch SWb included in the current bypass circuit 600 may operate such that an excessive current is provided to an external power source to increase a voltage when the current $i_{HV,REUSE}$ provided by the HV circuit is greater than the current $i_{LV}$ flowing through the LV circuit 500. In this case, the bypass switch SWb may be turned on to bypass at least some of the current provided to the LV circuit 500.

Figure 11:
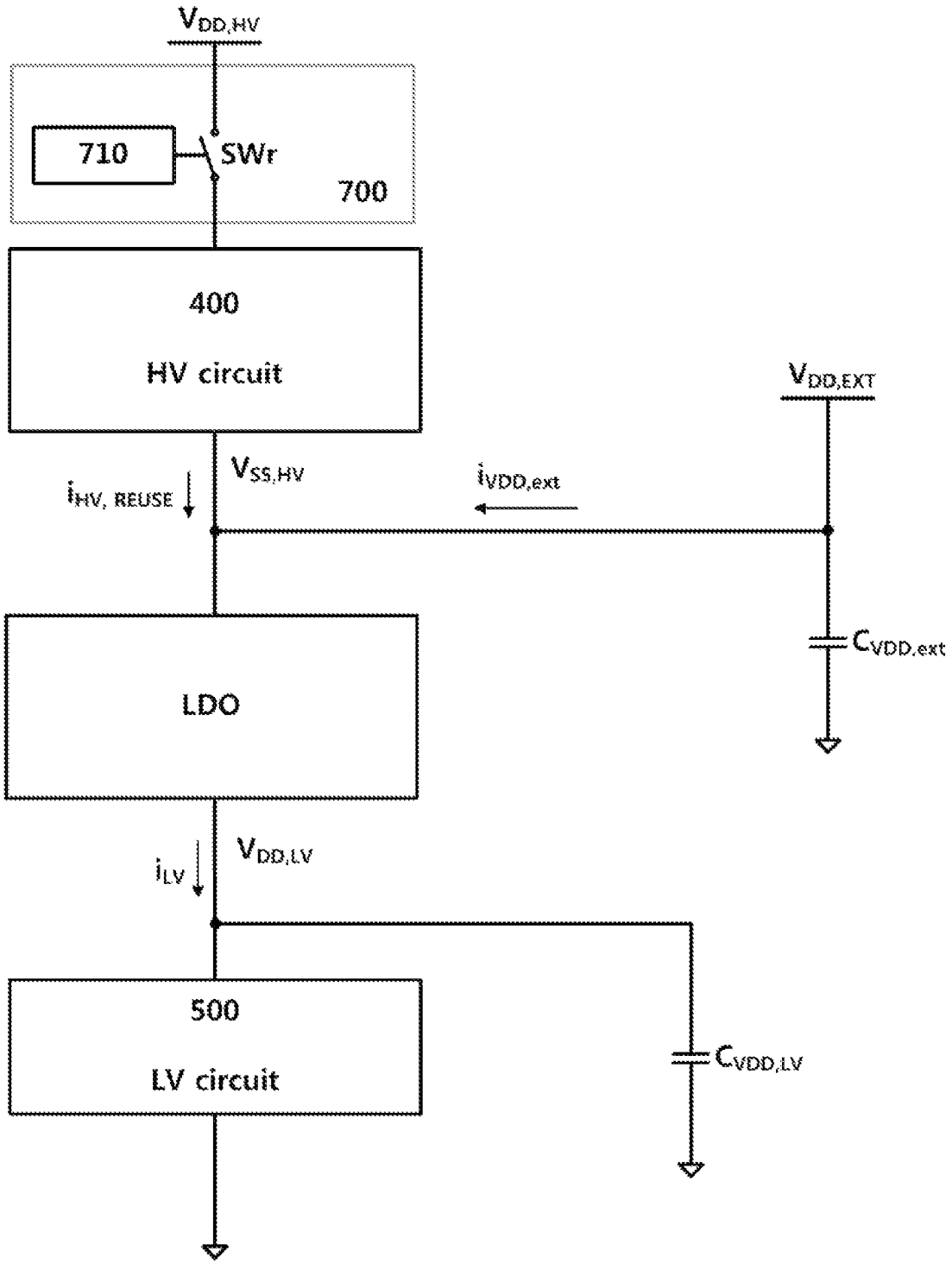
FIG. 11 is a schematic circuit diagram illustrating an embodiment of a backflow prevention circuit.

FIG. 11 is a schematic circuit diagram illustrating an embodiment of a backflow prevention circuit 700. According to the embodiment illustrated in FIG. 11, the backflow prevention circuit 700 includes a backflow prevention switch SWr interposed between the rail of the top voltage $V_{DD,HV}$ and the HV circuit 400 and includes a control circuit 710 configured to control the backflow prevention switch. According to an embodiment which is not illustrated, the backflow prevention circuit 700 includes a backflow prevention circuit interposed between the rail of the bottom voltage $V_{SS,HV}$ and the HV circuit 400 and a control circuit configured to control the backflow prevention circuit.

When a time in which the top voltage $V_{DD,HV}$ reaches a target voltage level is greater than a time in which the bottom voltage $V_{SS,HV}$ reaches a target voltage level in an initial operation stage of the HV circuit 400, a current which should be provided to the low voltage source LDO may flow backward from the bottom voltage toward the top voltage. The backflow prevention circuit 700 prevents a backflow of a current. As an embodiment, the control circuit (not shown) may include a level detector configured to compare the top voltage $V_{DD,HV}$ with a predetermined voltage level and control the backflow prevention switch SWr using a detected result.

According to a conventional technology, a current provide to a rail of a bottom voltage $V_{SS,HV}$ in a HV circuit 400 is provide to a ground voltage. Accordingly, since the current are not reused, power consumption is high. However, according to the present embodiments, since the HV circuit 400 provides a current provided to the rail of the bottom voltage $V_{SS,HV}$ to the LV circuit 500, a current needed to drive the LV circuit 500 can be decreased, and thus power consumption can be decreased.

The present invention has been described with reference to the embodiments illustrated in the drawings, but the embodiments are only examples, and it will be understood by those skilled in the art that another embodiment including various changes and equivalents may be made from the embodiments. Therefore, the scope of the present invention will be defined by the appended claims.

What is claimed is:

1. A display apparatus comprising:

a first circuit configured to process a signal between a first top voltage and a first bottom voltage;

a second circuit configured to process a signal between a second top voltage and a second bottom voltage; and a second circuit power source configured to receive a current provided by the first circuit and provide the second top voltage to the second circuit, wherein the second circuit includes a digital logic circuit, and wherein the first circuit and the second circuit are disposed in different deep wells.

2. The display apparatus of claim 1, wherein the first circuit includes a display driving circuit having any one or more of a level shift circuit, a digital-to-analog converter, and a pre-driver of a data driving amplifier.

3. The display apparatus of claim 1, wherein the first circuit includes a plurality of driving circuits each configured to drive a single data channel.

4. The display apparatus of claim 1, wherein the first circuit includes one or more display pixels.

5. The display apparatus of claim 1, wherein the second circuit includes a timing controller circuit.

6. The display apparatus of claim 1, wherein the first bottom voltage has a voltage value which is greater than that of the second top voltage.

7. The display apparatus of claim 1, wherein the first bottom voltage provided to the first circuit is selectable according to a dynamic range of the first circuit.

8. The display circuit of claim 1, further comprising a backflow prevention circuit, wherein the backflow prevention circuit is interposed between a top power source rail configured to provide the first top voltage and the first circuit, and is turned off when the bottom voltage is greater than the top voltage.

9. The display apparatus of claim 1, further comprising a backflow prevention circuit, wherein the backflow prevention circuit is interposed between a bottom power source rail configured to provide the first bottom voltage and the first circuit, and is turned off when the first bottom voltage is greater than the first top voltage.

10. The display apparatus of claim 1, further comprising a current bypass circuit, wherein the current bypass circuit bypasses at least some amount of the current provided by the first circuit when the current is greater than a current provided by the second circuit.

11. The display apparatus of claim 1, wherein the first bottom voltage has a voltage value which is greater than that of a ground.

12. The display apparatus of claim 1, wherein:

the first top voltage and the first bottom voltage are provided as a pair of driving voltages of the first circuit; and the second top voltage and the second bottom voltage are provided as a pair of driving voltages of the second circuit.

13. A display apparatus comprising:

a first circuit configured to process a signal between a first top voltage and a first bottom voltage;

a second circuit configured to process a signal between a second top voltage and a second bottom voltage;

a second circuit power source configured to provide the second top voltage to the second circuit; and a first dynamic range securing switch configured to be turned on to provide a voltage which is less than a driving voltage provide to the second circuit power source as the first bottom voltage.

14. The display apparatus of claim 13, further comprising a second dynamic range securing switch configured to be turned off such that the first bottom voltage is not provided to a driving source of the second circuit when the first dynamic range switch is turned on.

15. The display apparatus of claim 13, further comprising a second dynamic range securing switch configured to be turned on to provide a voltage which is less than a driving voltage provided to the second circuit power source as the bottom voltage when the first dynamic range securing switch is turned off.

* * * * *